United States Patent [19]

Peters et al.

[11] Patent Number: 5,072,480

[45] Date of Patent: Dec. 17, 1991

[54] BACKBRUSH ASSEMBLY

[76] Inventors: Margery S. Peters, 1651 Desert Flower Dr., Las Vegas, Nev. 89115; Ivor Waaka, 3 Dorothy Street, Pendle Hill, NSW 2145 Sydney, Australia, 6881412

[21] Appl. No.: 594,608

[22] Filed: Oct. 5, 1990

[51] Int. Cl.[5] ..... A47K 7/02

[52] U.S. Cl. ..... 15/114; 4/606; 15/110; 15/117; 15/160; 128/62 R

[58] Field of Search ..... 15/105, 110, 160, 159 R, 15/114, 117; 4/606; 128/62 R, 67, 24 R

[56] References Cited

U.S. PATENT DOCUMENTS

| | | | |
|---|---|---|---|
| 1,954,940 | 4/1934 | Mikel | 15/110 |
| 3,750,226 | 8/1973 | Morgan | 4/606 |
| 4,003,372 | 1/1977 | Willoby | 15/110 |
| 4,023.567 | 5/1977 | Wessel | 15/110 |
| 4,417,362 | 11/1983 | Walker | 4/606 |
| 4,704,759 | 11/1987 | Mesa | 15/110 |

*Primary Examiner*—Edward L. Roberts
*Attorney, Agent, or Firm*—Leon Gilden

[57] ABSTRACT

An organization arranged for mounting in a fixed relationship relative to a shower wall and the like, including a rigid support plate, with a matrix of suction cups mounted to a rear surface thereof. Alternating resilient and deformable polymeric projections are arranged in rows alternating with bristle brush rows, each of an equal predetermined length. A modification of the invention includes elongate blade members formed with a forward edge wherein each blade member and edge are arranged in a parallel alternating relationship relative to the brush and projection rows. A further modification arranges the blade members in a perimeter orientation to define a framework about the brush and projection rows to provide a wiping relationship of soap and moisture on an individual's back.

5 Claims, 4 Drawing Sheets

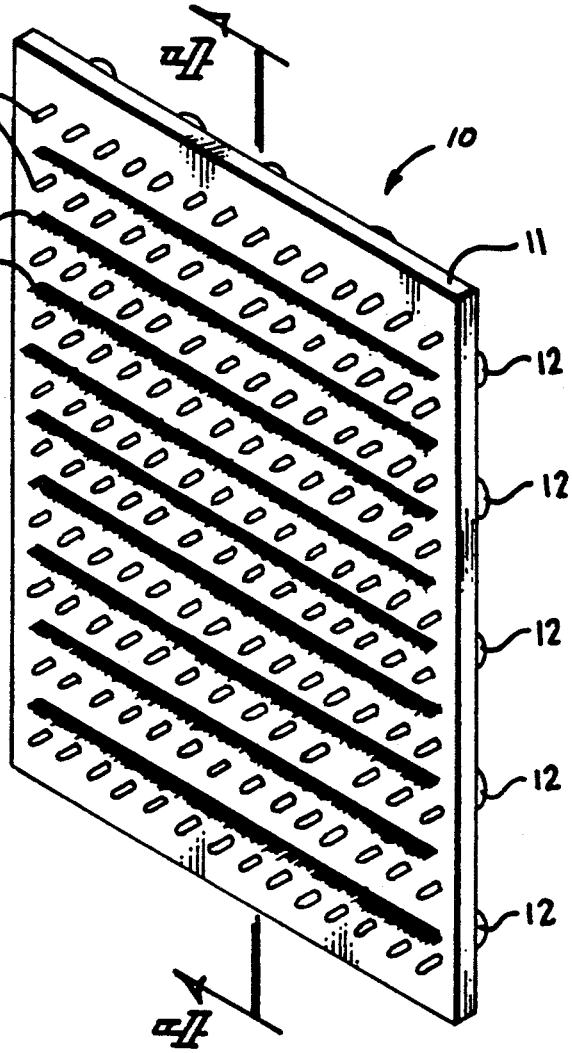
FIG 3
FIG 4
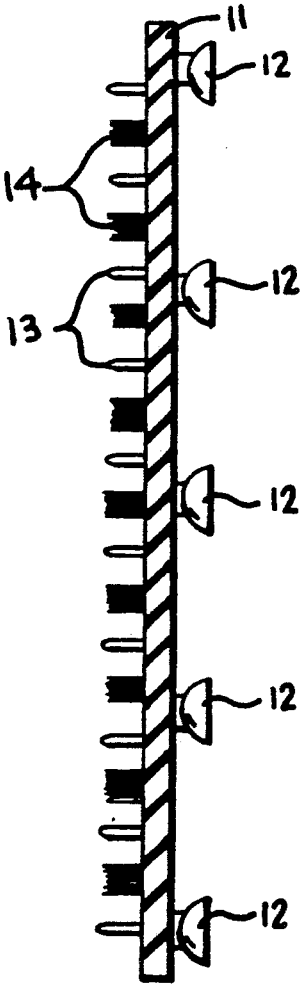

BACKBRUSH ASSEMBLY

BACKGROUND OF THE INVENTION

1. Field of the Invention

The field of the invention relates to brush structure, and more particularly pertains to a new and improved backbrush assembly wherein the same is arranged for mounting to a shower wall and like to enhance brushing and cleaning of an individual's back during a showering procedure.

2. Description of the Prior Art

Various brush assemblies are provided in the prior art to enhance brushing and cleansing of an individual, such as utilized in a shower, bath and the like. Such structure may be found in U.S. Pat. No. 4,704,759 to Mesh wherein a backbrush device includes a plate mounted to a support wall, wherein the plate includes a series of rows of brush bristles directed outwardly from the plate.

U.S. Pat. No. 4,696,068 to Kenner sets forth a shower wall back washer that is mounted to a shower wall, including a fiber-like covering, with a predetermined quantity of soap cakes mounted thereunder to enhance lathering and brushing of an individual.

U.S. Pat. No. 4,759,091 to Kiss wherein a brush assembly includes a plurality of elongate brushes mounted in a spaced relationship relative to a plate that in turn is mounted to a wall surface to facilitate brushing an individual's back and the like.

U.S. Pat. No. 3,750,226 Morgan sets forth a "T" shaped cleaning and massaging device adapted for mounting on the walls of shower stalls for the washing and cleaning of an individual's back.

U.S. Pat. No. 4,417,362 to Walker provides a bathroom fixture, wherein a brush and sponge arrangement are mounted to a plate structure secured to a wall surface of a shower stall and the like.

As such, it may be appreciated that there continues to be a need for a new and improved backbrush assembly as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of backbrush organizations now present in the prior art, the present invention provides a backbrush assembly wherein the same when mounted to a shower stall wall provides enhanced brushing and cleaning of an individual's back during a showering procedure. As such, the general purpose of the present invention, which will be described subsequently in greater detail, is to provide a new and improved backbrush assembly which has all the advantages of the prior art backbrush organizations and none of the disadvantages.

To attain this, the present invention provides an organization arranged for mounting in a fixed relationship relative to a shower wall and the like, including a rigid support plate, with a matrix of suction cups mounted to a rear surface thereof. Alternating resilient and deformable polymeric projections are arranged in rows alternating with bristle brush rows, each of an equal predetermined length. A modification of the invention includes elongate blade members formed with a foward edge wherein each blade member and edge are arranged in a parallel alternating relationship relative to the brush and projection rows. A further modification arranges the blade members in a perimeter orientation to define a framework about the brush and projection rows to provide a wiping relationship of soap and moisture on an individual's back.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the sprit and scope of the present invention.

Further, the purpose of the foregoing abstract is to eneble the U.S. Patent and Trademark Office and the public generally, and especially the scientists, engineers and practitioners in the art who are not familar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved backbrush assembly which has all the advantages of the prior art backbrush organizations and none of the disadvantages.

It is another object of the present invention to provide a new and improved backbrush assembly which may be easily and efficiently manufactured and marketed.

It is a further object of the present invention to provide a new and improved backbrush assembly which is of a durable and reliable construction.

An even further object of the present invention is to provide a new and improved backbrush assembly which is susceptible of a low cost of manufacture with regard to both materials and labor, and which accordingly is then susceptible of low prices of sale to the consuming public, thereby making such backbrush assemblies economically available to the buying public.

Still yet another object of the present invention is to provide a new and improved backbrush assembly which provides in the apparatuses and methods of the prior art some of the advantages thereof, while simultaneously overcoming some of the disadvantages normally associated therewith.

Still another object of the present invention is to provide a new and improved backbrush assembly wherein the same provides alternating rows of brush bristles, flexible polymeric projections, and blade organizations that are mounted to effect a brushing and subsequent wiping of an individual's back during a showering procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of Section 3, as set forth in FIG. 2.

FIG. 4 is an orthographic cross-sectional illustration, taken along the lines 4—4 of FIG. 3, in the direction indicated by the arrows.

DESCRIPTION OF THE PREFERRED EMBODIMENT

Figure 1:
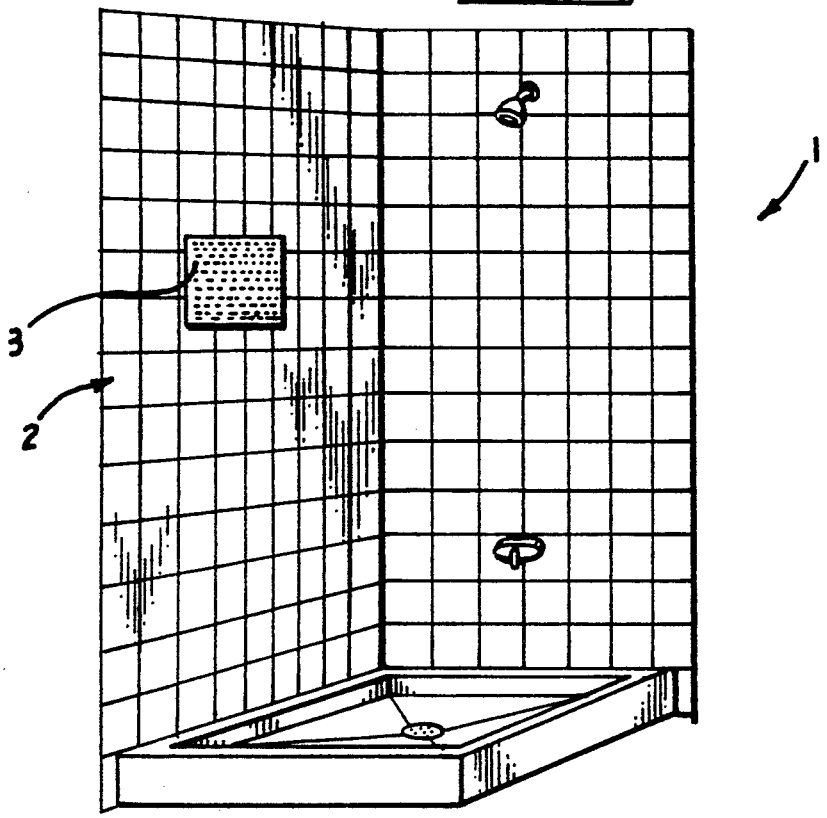
FIG. 1 is an isometric illustration of a prior art organization mounted to a shower stall.

With reference now to the drawings, and in particular to FIGS. 1 to 8 thereof, a new and improved backbrush assembly embodying the principles and concepts of the present invention and generally designated by the reference numerals 10, 10*a*, 10*b*, and 10*c* will be described.

FIG. 1 illustrates a prior art backbrush organization, as set forth in U.S. Pat. No. 4,704,759, wherein the plate-like member 3 and associated bristle brush matrix organization is mounted to a shower stall 2.

Figure 2:
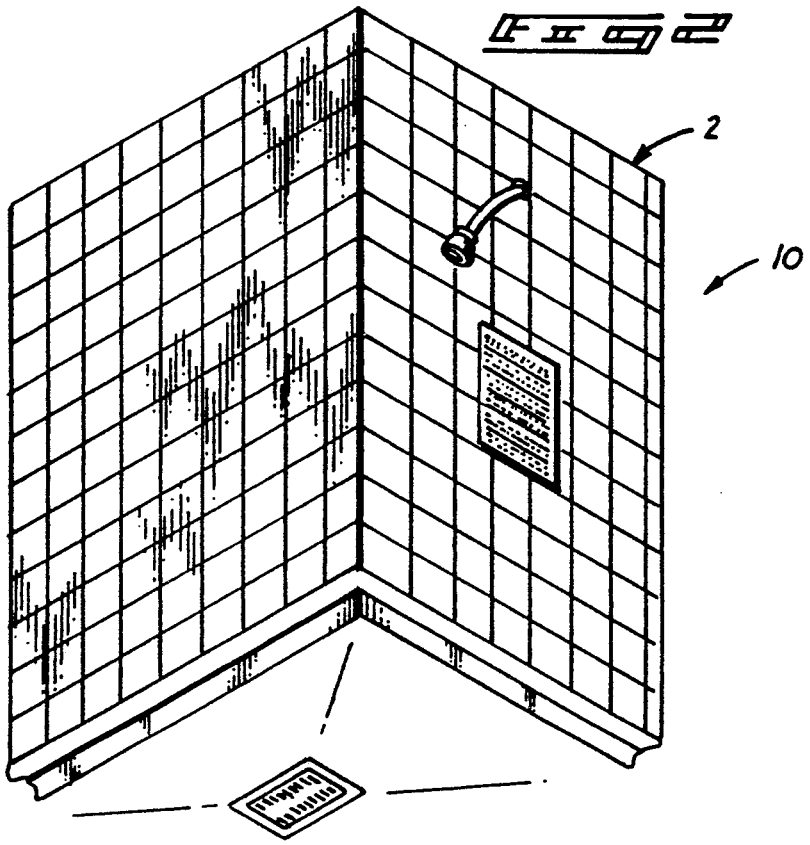
FIG. 2 is an isometric illustration of the instant invention and its mounting to a shower stall wall.

More specifically, the backbrush assembly 10 of the instant invention, as illustrated in FIG. 3 for example, sets forth the use of a rigid support plate 11 of a generally fluid impermeable material. The plate includes a planar rear and planar forward surface arranged in a parallel relationship relative to one another. A matrix of suction cups 12 are orthogonally mounted to the rear surface of the support plate 11 for mounting on the shower wall, as illustrated in FIG. 2 for example. Alternating rows of cleansing members are mounted on the forward surface. These rows include a row of resilient and deflectable polymeric projections 13, each formed of a memory retentent construction, and generally of a clylindrical configuration, terminating in a forward pointed projection. Alternating with the polymeric projections are bristle brush rows 14, each of an elongate continuous configuration longitudinally aligned and arranged in a parallel relationship to the polymeric projections. It should be noted that each of the rows of polymeric projections and bristle brush rows are of an equal predetermined length.

Figure 5:
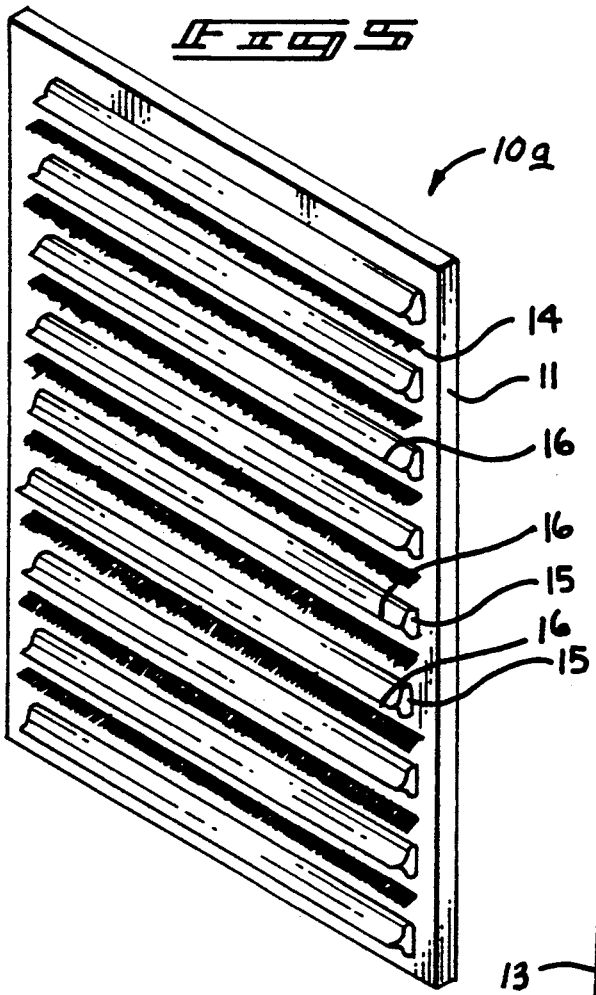
FIG. 5 is an isometric illustration of a modification of the instant invention.
Figure 6:
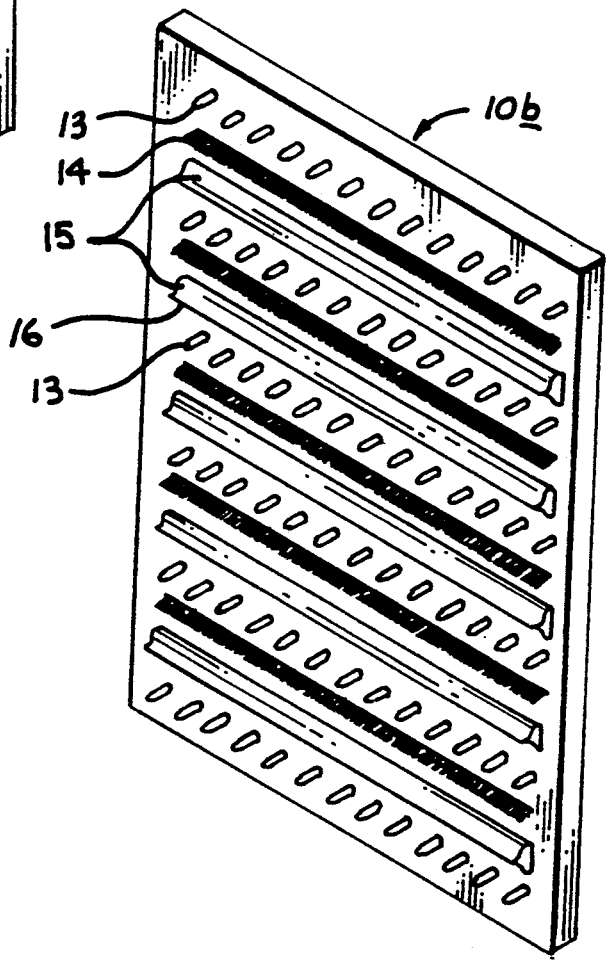
FIG. 6 is an isometric illustration of a further modification of the instant invention.

FIG. 5 illustrates a modified backbrush assembly 10*a*, including elongate elastomeric blade members 15 that are coextensive and parallel to the projection and bristle brush rows 13 and 14 respectively, wherein each of the blade members 15 terminates in a forward elongate edge 16, with each of the edges 16 arranged relatively parallel to one another and coextensive with the blade members, in a manner as set forth in FIGS. 5 and 6, wherein FIG. 5 illustrates the use of the bristle brush rows 14 and blade members, wherein the relation of FIG. 6 sets forth the blade members in cooperation with the projections 13 and the bristle brush 14.

Figure 6A:
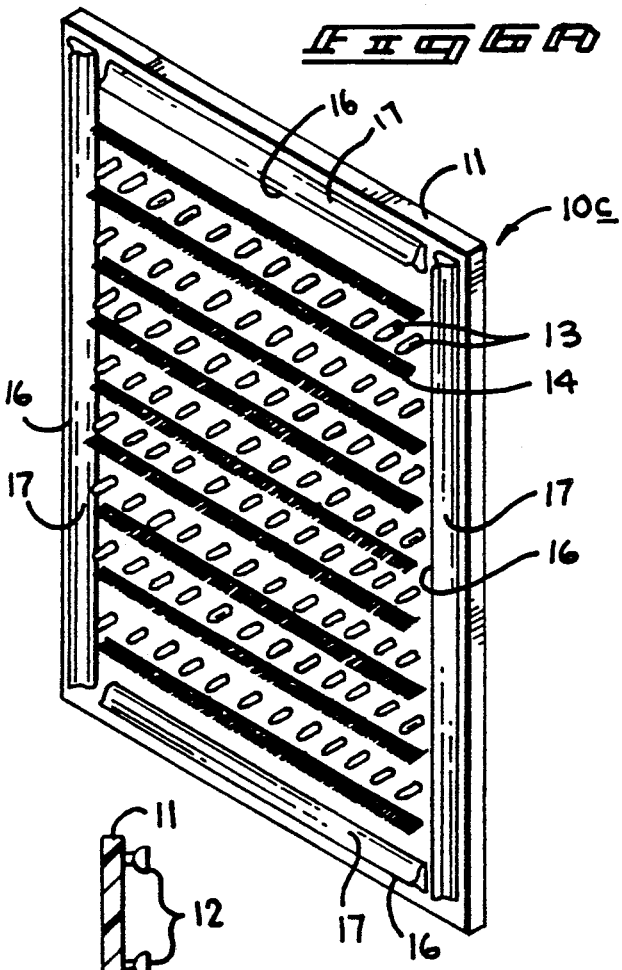
FIG. 6*a* is an isometric illustration of a yet further modification of the instant invention.

FIG. 6*a* illustrates a use of the blade members 15 and the associated blade edges, wherein they are provided in a perimeter and surrounding relationship relative to alternating rows of projections 13 and bristle brush rows 14, including an upper, lower, right side, and left side perimeter blade member 17, each formed with an associated forward edge 16 to provide a framework about the central portion of the forward surface of the support plate 11 to effect a wiping action subsequent to a lathering and rinsing procedure in use of the projections 13 and brush rows 14.

Figure 7:
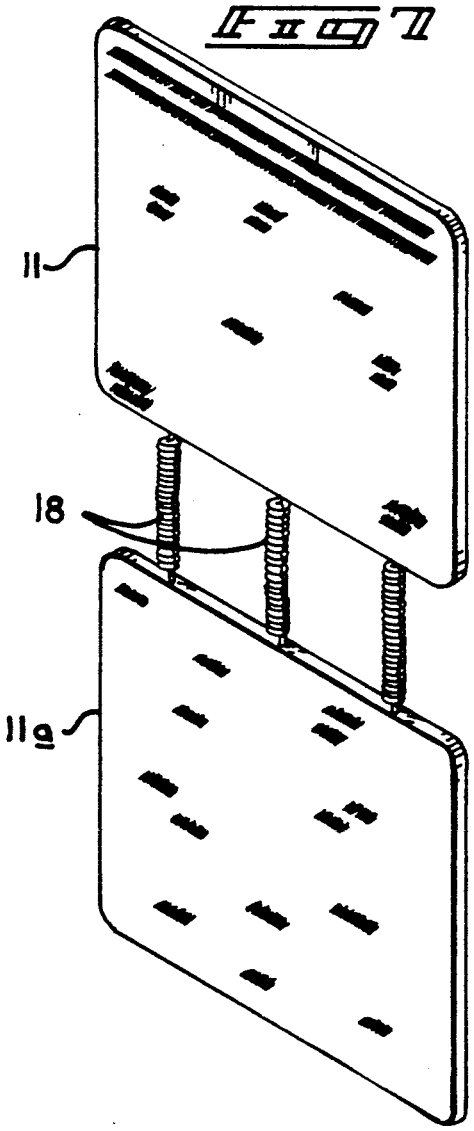
FIG. 7 is an isometric illustration of a mounting of the instant invention utilizing a plurality of support plates and associated brush and projection matrix organizations.
Figure 8:
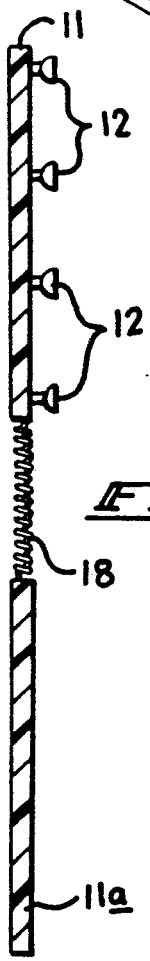
FIG. 8 is an orthographic side veiw, taken in elevation, illustrating the mounting of the dual support plates of the instant invention.

FIGS. 7 and 8 illustrate the use of any of the organizations as set forth in the FIGS. 3–6*a*, wherein the upper plate 11 includes a lower support plate 11*a*. Spaced parallel coil spring 18 resiliently mount the lower support plate 11*a* to the support plate 11 in an aligned underlying relationship. In this manner, an individual may utilize the lower support plate and upon imposing a force thereon during a brushing and lathering procedure, subsequent release of a portion of such force permits the spaced coil return springs 18 to project the lower plate upwardly from a lowered biased relationship once stretched by an individual to effect a brushing action onto the individual and an individual's back during a washing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and change will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A backbrush assembly comprising, a rigid support plate, the support plate formed with a fluid impermeable material, including a rear surface parallel to a forward surface, and the rear surface including a matrix of suction cups mounted to the rear surface for securement of the support plate to a support wall, and spaced parallel alternating rows of cleaning members, including first rows of resilient deformable polymeric projections and second rows of bristle brush members, wherein the first rows and second rows are in alternating and equally spaced relationship relative to one another, and the first and second rows are of an equal predetermined length.

2. An apparatus as set forth in claim 1 including elongate elastomeric blade members fixedly mounted to the forward surface in a surrounding relationship to the first and second rows.

3. An apparatus as set forth in claim 2 wherein the blade members include a right blade member, a left blade member, a top blade member, and a bottom blade member to define a surrounding perimeter of the blade member, and each blade member includes an elongate forward edge coextensive with each blade member, wherein the forward edge of the top blade member and the bottom blade member are parallel, wherein the forward edge of the right blade member and the left blade member are parallel, and wherein the forward edge of the right and left blade members are orthogonally arranged relative to the forward edge of the top and bottom blade members.

4. An apparatus as set forth in claim 2 including a lower support plate, the lower support plate includes a plurality of parallel coil return springs to bias the lower support plate relative to the support plate, and the lower support plate including alternating rows of the first and second rows in a parallel equally spaced coextensive relationship to one another.

5. An apparatus as set forth in claim 4 wherein the lower support plate includes a top blade member, a bottom blade member, a right blade member, and a left blade member arranged in a surrounding perimeter relationship relative to the first and second rows of the lower support plate.

* * * * *